United States Patent [19]

Vallarino et al.

[11] 4,262,088

[45] Apr. 14, 1981

[54] PHOTOGRAPHIC MATERIAL HAVING A REMOVABLE ANTIHALO LAYER

[75] Inventors: Angelo Vallarino, Spotorno; Alberto Valsecchi, Ferrania, both of Italy

[73] Assignee: Minnesota Mining and Manufacturing Company, St. Paul, Minn.

[21] Appl. No.: 77,192

[22] Filed: Sep. 20, 1979

[51] Int. Cl.[3] ..... G03C 1/84

[52] U.S. Cl. ..... 430/514; 430/515; 430/516; 430/517

[58] Field of Search ..... 430/513, 514, 515, 516, 430/517

[56] References Cited

U.S. PATENT DOCUMENTS

| | | | |
|---|---|---|---|
| 3,201,249 | 8/1965 | Pierce et al. | 430/514 |
| 4,039,333 | 8/1977 | Shinagawa et al. | 430/531 |

FOREIGN PATENT DOCUMENTS

| | | | |
|---|---|---|---|
| 1435145 | 5/1976 | United Kingdom | 430/514 |

*Primary Examiner*—J. Travis Brown

*Attorney, Agent, or Firm*—Cruzan Alexander; Donald M. Sell; Mark A. Litman

[57] ABSTRACT

A photographic material containing a removable antihalo layer comprising an antihalo agent and a mixture of two copolymers of a low alkymethacrylate and acrylic or methacrylic acid.

10 Claims, No Drawings

PHOTOGRAPHIC MATERIAL HAVING A REMOVABLE ANTIHALO LAYER

The present invention refers to an improvement in the preparation process of silver halide photographic materials which include an easily removable antihalo layer from the side of the base opposite to that carrying the light sensitive emulsion layers and to materials obtained according to said process.

The photographic materials must be protected against the halation phenomenon which is caused by light reflected from the base of the photographic material to the light sensitive layers.

Said halation defect can be removed by coating a light absorbing layer (generally called antihalo layer) on the side of the base opposite that on which light-sensitive layers are coated. Such antihalo layers generally consist of a dye or a pigment dispersed in a natural or synthetic binding resin.

There are basically two alternatives in the formulation of such antihalo layers: (1) the "decolorizable" type wherein dyes or the pigments included in the antihalo layer are decolorized during the processing; and (2) the "removable" type, wherein the binding resin is soluble during processing.

In the removable type of antihalo layer binding resins, which must be soluble in the alkaline water solutions, and carbonblack or colloidal carbon dispersed in such resins are used.

Some of these resins are for instance described in U.S. Pat. Nos. 2,271,234, 2,327,838, 3,392,022, 3,262,782 and in BE Pat. No. 613,472.

In some recent development systems for black and white and color photography, the film is submerged in a preliminary imbibing (non-removing) bath, which is an alkaline solution of a high salt content; depending upon the process, this solution may serve some other functions (such as prehardening or developing) or its sole purpose may be that of making the antihalo layer soluble (for example, a prebath or a backing removal solution); then, after leaving the alkaline solution the film is washed with water to remove tha antihalo layer. It may be desirable furthermore to coat a magnetic track on the side of the support freed from said antihalo layer.

As a rule, the antihalo layer should not dissolve in such imbibing bath, which merely must salify the acid groups of the binding resins to give them the solubility in water. To prevent the contamination of the imbibing bath, the resin of the antihalo layer has to remain compact and must not dissolve in it, even if it is salified in said imbibing bath. Non-substantial removal of the antihalo layer in the imbibing bath is in fact necessary to avoid possible scratches on the film. During a following washing step with water, prior to entering the first developing bath, the antihalo layer must be easily and totally removed. Sometimes in such washing step with water, jets of water under pressure are used to remove the whole layer perfectly.

It is very difficult to formulate antihalo layers which can be totally removed by means of mere water jets. If resins easily soluble in the alkaline water solutions are used to allow the total removal by means of mere water jets, the integrity of the antihalo layer results to be too low to withstand the imbibing bath, such that it tends to contaminate the imbibing bath itself. If on the contrary a resin with a lower solubility in the alkaline water solution is used to have an integrity in the imbibing bath such as not to contaminate it, the removability of the antihalo layer by means of mere water jets is not totally assured and a thin "veil" of antihalo film may remain on the supporting base under the form of fog. Usually in the photographic processes under consideration, after or during the washing step with water jets, the photographic material dipped into current water is put in contact with rotating rollers covered with a soft material or with brushes provided with bristles, to remove the residual antihalo layer. Less than perfect functioning of the mechanical action of the rollers or brushes, due to wear or defects of the same, often causes an incomplete removal of the antihalo layer.

A material having an antihalo layer which retains its integrity in the imbibing bath and is easily removable in a subsequent washing step is described in U.S. Pat. No. 4,039,333; this layer includes a mixture of resins substantially consisting of a terpolymer containing from 10 to 25% of alkylacrylate units, from 52 to 65% of alkylmethacrylate units and from 18 to 30% of acrylic or methacrylic acid, and a resin soluble in aqueous alkali solution.

Such a layer, however, is not completely removable with water jets without the mechanical action exerted by the contact with the rotating rollers or brushes.

The main object of the present invention is to obtain antihalo layers for black and white and color photographic materials which do not substantially remove in a standard alkaline imbibing bath, while they do totally remove in a standard washing step with only water sprays (that is without any mechanical action as for example exerted by a rotating buffer).

Such alkaline imbibing bath and washing steps are those normally known in the art of color positive films as for example referred to by Charleton C. Bard and James E. Dumm in Journal of the SMPTE, 80 (July 1971), 564–569. Particular reference can be made to described ECP conditions. More precisely, it is the object of the present invention to provide a material and a method to obtain it having the following characteristics in standard ECP type process:

| | | |
|---|---|---|
| Pre-bath (an alkaline solution containing sodium sulfate, sodium hydroxide and borax) at 27° C. | (A) | M.I.T. lower than 10 seconds |
| | (B) | Non-substantial removal at times of 10–20 seconds. |
| Washing bath with water sprays at 27° C. or 20° C. (without rotating buffer) | (C) | Total removal for a time of 2 seconds (with normal water treatment including water usage of 3 gallons/min. at a pressure of 0.5 atm.). |

M.I.T. is the Minimum Imbibition Time (in a standard solution referred to in example 6 of the specification), that is the minimum time required by the material to be in the pre-bath to have the antihalo layer removed in the subsequent washing step with water at standard conditions, including the mechanical action of the rotating buffer described in the above cited Journal of SMPTE with Mohair as buffer material. Substantial removal of the antihalo layer has been measured to be equal to at least 80% of the layer itself.

Non-substantial removal (i.e. a removal acceptable in the above referred ECP type process) has been roughly evaluated to be no more than 50% and, in most cases, less than about 10 to 20% of the layer.

A criticality was observed in the sense that medium values of removal were not found to be present in layers. Amounts of removal were either high (unacceptable) or low (acceptable). Total removal of the layer means a 100% removal of it.

Other alkaline imbibing baths and washing steps are those normally known in the art of color reversal films, wherein an alkaline imbibition step (called Rem-jet remover) and a washing (or rinsing) step follow prehardening and neutralizing steps. Particular reference can be made to EM-25 process conditions. More precisely, another object of the present invention is to provide a material and a method to obtain it having the following characteristics in standard EM-25 type Process:

| | | |
|---|---|---|
| Rem-jet Remover overflow solution from the first developer tank) at 52° C. | (A) | M.I.T. lower than 2 seconds |
| Rinse with water sprays (without rotating buffer) at 52° C. | (B) | Total removal for a time of 3 seconds (under conditions previously described). |

M.I.T. substantial removal and total removal have the same meanings as above.

A still further object of the present invention is to obtain a photographic material having a removable antihalo layer, such as to allow, at the end of the processing, some auxiliary operations to be performed on the supporting base, such as coating of the magnetic track.

These and other objects of the present invention have been achieved by using an antihalo composition comprising an antihalo agent dispersed in a water alkali soluble binding material substantially consisting of a mixture of two copolymers (low alkylmethacrylate-acrylic or methacrylic acid), the relative quantities of acrylic or methacrylic acid in the two copolymers and the ratios in which the two copolymers are mixed being such that a layer imbibible and compact in said imbibing bath and removable by means of mere washing operation is obtained. Preferably, said antihalo agent is carbonblack, said alkylmethacrylate is methylmethacrylate and said acrylic or methacrylic acid is methacrylic acid. The percent quantities of acrylic or methacrylic acid preferably range from 40 to 50, more preferably from 42 to 48 and most preferably are 45 in the first copolymer, while they preferably range from 20 to 30, more preferably from 22 to 26 and most preferably are 25 in the second copolymer. The percent quantity of said first copolymer being preferably from 30 to 50 percent of the combined weight of its mixture with said second polymer. Preferably, said mixture of the two copolymers is added with a resin soluble in an alkaline water solution as a viscosity control agent of the antihalo layer coating composition. Preferably, such resin is a synthetic copolymer or a cellulose derivative containing carboxylic groups. More preferably, such resin is hydroxypropylmethylcellulose phthalate.

Hence, the present invention refers to an improvement in the preparation of a photographic material, which includes a supporting base, at least a silver halide emulsion layer coated on one side of said supporting base and an antihalo layer coated on the other side of said supporting base, useful in a process which includes an alkaline imbibing bath and a subsequent water washing bath, wherein said antihalo layer is to be imbibed without being removed and removed in said washing bath, the improvement consisting in that said antihalo layer substantially consists of an antihalo agent (e.g., dye, pigment, or carbonblack) and of the mixture of two copolymers of a low alkylmethacrylate and acrylic or methacrylic acid, the first being richer in acrylic or methacrylic acid, (which would give, if used alone, an antihalo layer at least partially removable in the imbibition step), and the second being less rich in acrylic or methacrylic acid, (which would give, if used alone, an antihalo layer not imbible in the imbibing bath in the desired time and therefore not removable in the subsequent water washing step), the relative quantities of acrylic or methacrylic acid in the two copolymers, and the ratios in which the copolymers themselves are mixed, being such that an antihalo layer imbibible and not removable in said imbibing bath and removable in said washing bath is obtained.

The present invention further consists of a photographic material comprising a supporting base, at least one silver halide emulsion layer coated on one side of said supporting base and an antihalo layer coated on the other side of said supporting base, such antihalo layer substantially consisting of an antihalo agent and of a copolymer mixture of a low alkyl-methacrylate and acrylic or methacrylic acid, as defined hereinabove.

More particularly, the present invention consists of an antihalo layer of a photographic material as described above, said layer being substantially made up of an antihalo agent and of a mixture of alkylmethacrylate, wherein said alkyl contains from 1 to 4 carbon atoms, and acrylic or methacrylic acid copolymers, and more preferably of a mixture of methylmethacrylatemethacrylic acid copolymers.

The present invention further consists of an antihalo layer of a photographic material, as described above, said antihalo layer being substantially made up of an antihalo agent of a mixture of low alkyl (preferably methyl) methacrylate-acrylic or methacrylic (preferably methacrylic) acid copolymers, the first having from 40 to 50% w/w of acrylic or methacrylic acid and the second from 20 to 30% w/w of acrylic or methacrylic acid; more preferably the first copolymer having from 42 to 48% w/w of acrylic or methacrylic acid and the second copolymer having from 22 to 28% of acrylic or methacrylic acid; most preferably the first copolymer having 45% w/w of methacrylic acid and the second copolymer having 25% w/w of methacrylic acid. According to the present invention, the two copolymer mixture comprises from 30 to 50 w/w of the copolymer richer in acrylic or methacrylic acid. The present invention further consists of a photographic material, as described above, wherein the antihalo layer, in addition to the antihalo agent and the two copolymer mixture, preferably comprises a polymeric resin soluble in an alkaline water solution as a viscosity control agent of the antihalo layer coating composition, such resin being preferably a synthetic copolymer or a derivative of cellulose containing carboxylic groups, more particularly such resin being hydroxypropylmethylcellulose phthalate. Other examples of these aqueous alkaline solution stable resins are known in the art.

The antihalo layer of the present invention preferably contains from 30 to 42% w/w of the low alkyl (preferably methyl) methacrylate-acrylic or methacrylic acid copolymer richer in acrylic or methacrylic acid, from 53 to 60% w/w of the low alkyl (preferably methyl) methacrylate-acrylic or methacrylic acid copolymer less rich in acrylic or methacrylic acid and from 0 to 15% w/w of said resin soluble in an alkaline water solution.

We have found that the two low alkylmethacrylate-acrylic or methacrylic acid copolymers which make up the mixture of the antihalo composition of the present invention, must contain a different percent quantity of acrylic or methacrylic acid.

We have found in fact that antihalo layers of photographic materials, including as binding materials the two copolymers according to the present invention used individually, if dipped into an alkaline water pre-bath of a color positive film containing sodium sulfate, borax and sodium hydroxide for a two minute time, in the case of the copolymer richer in acrylic or methacrylic acid, softened so much that a mechanical contact scratches away the antihalo layer completely and, in the case of the copolymer less rich in acrylic or methacrylic acid, said layer remains compact even if in the presence of a mechanical contact.

We have found that antihalo layers of photographic materials, having as binding resin the combination of the two copolymers according to the present invention, if dipped into an alkaline pre-bath as that described above, even for a two minute time remain intact and keep their original form even if they undergo to mechanical contacts in said pre-bath, but are easily and completely removable in the subsequent water washing step. Antihalo layers of the individual components only either soften too much or do not soften enough in the pre-bath.

The removability of the antihalo layer in the washing step following the imbibition in the pre-bath depends in part upon the imbibition time and the pre-bath temperature, and of course, upon its nature and storage conditions. A specific parameter useful to characterize the behavior of an antihalo layer is the Minimum Imbibition Time in the pre-bath at a given temperature. As said before, M.I.T. is the minimum time required by the material to be in the pre-bath to have the antihalo layer removed in the subsequent washing step with water at standard conditions including the mechanical action of a rotating buffer. With an imbibition time of an antihalo layer in the pre-bath lower than M.I.T., said layer is not completely removable from the supporting base of the photographic material in the washing step including also the mechanical action of the rollers or brushes; with an imbibition time equal or higher than M.I.T., on the contrary, the antihalo layer is completely removed in the washing step including also the mechanical action of the rollers or brushes.

We have determined that the copolymers (low alkylmethacrylate-acrylic or methacrylic acid) poorer in acrylic or metharylic acid, if used alone, give antihalo layers with an M.I.T. at 20° C. ranging from 50 to 120 seconds, which is certainly higher than the normal imbibition time in the pre-bath of the photographic process; we have found furthermore that the same antihalo layers, stored from 24 to 48 hours at a temperature of 105° C. and relative humidity of 25% to simulate advanced aging conditions of the material, tend to have infinite M.I.T.s, i.e. they cannot be any more imbibed. To the contrary, the copolymers (low alkylmethacrylate-acrylic or methacrylic acid) richer in acrylic or methacrylic acid, if used alone, give antihalo layers with a M.I.T. ranging from 7 to 8 seconds, which is certainly lower than the normal imbibition time in the pre-bath of the photographic processings. Moreover, if storaged as said above, they tend to double the M.I.T. values of the antihalo layers containing them.

We have found on the contrary, according to the present invention, that antihalo layers of photographic materials, having as binding resin the combination of the two copolymers according to the present invention, have an M.I.T. ranging from 8 to 9 seconds and furthermore that such M.I.T. remains the same or undergoes only a slight increase for the same antihalo layers stored as described above.

A means of evaluating the total removability of the antihalo layers, which, after having left the preliminary alkaline bath, undergo the washing bath consisting merely of water jets under pressure, is to evaluate the residual fog (as optical density of absorption in the visible light field) left by the thin film of the antihalo layer not completely removed.

We have experimentally noted that antihalo layers of photographic materials, having as binding resins only the low alkylmethacrylate-acrylic or methacrylic acid copolymers less rich in acrylic or methacrylic acid, after an ambibition time in the pre-bath corresponding to the M.I.T. of that layer at that temperature, when they undergo a washing bath with mere water jets at a 0.5 atmosphere pressure, as in the normal processes, or even at 0.1 atmosphere pressure, give no residual fog or a fog which is equal to the optical density of the layer which has not undergone the photographic processing (i.e. the antihalo layer is not removed) for the same layers storaged at 105° C. and 25% R.H. for 24 to 48 hours.

We have furthermore noticed that antihalo layers of photographic materials, having as binding resins only the low alkylmethacrylate-acrylic or methacrylic acid copolymers richer in acrylic or methacrylic acid, after an imbibition time in the pre-bath corresponding to the M.I.T. of that layer at that temperature, give a high residual fog, both if they are stored as said above or not, when they undergo the same washing step.

We have found, on the contrary, that antihalo layers of photographic materials, having as binding resins the copolymer mixture according to the present invention, after an imbibition time in the pre-bath corresponding to the M.I.T. of that layer, give no residual fog, when they undergo the washing step with mere water jets under pressure, without the need of any additional mechanical action, whatever may be the storage state of the antihalo layer.

The two copolymers are different one from the other in the percentage content of acrylic or methacrylic acid; one is richer and may contain from 40 to 50% w/w of acrylic or methacrylic acid, the other is poorer and may contain from 20 to 30% w/w of acrylic or methacrylic acid. Both copolymers preferably have an intrinsic viscosity (in ethanol at 25° C.) of 0.1 to 0.5, most preferably between 0.15 and 0.3, higher or lower values being chosen when a higher or a lower binding power is respectively desired, as known in the art.

According to the present invention, the first copolymer preferably contains from 42 to 48% w/w of acrylic or methacrylic acid and the second copolymer includes from 22 to 28% w/w of acrylic or methacrylic acid.

More preferably, according to the present invention, the first copolymer is the copolymer (methylmethacrylate-methacrylic acid) containing 45% w/w of methacrylic acid and the second copolymer is the copolymer (methylmethacrylate-methacrylic acid) containing 25% w/w of methacrylic acid. The two copolymers are insoluble in water at room temperature and easily in an alkaline water solution at room temperature.

The mixing ratio between the copolymer richer in acrylic or methacrylic acid and the copolymer poorer in acrylic or methacrylic acid of the antihalo composition according to the present invention may vary within certain limits, an excess with respect to these limits of the copolymer richer in acrylic or methacrylic acid giving rise to an antihalo layer which remains less intact in the pre-bath, while an excess with respect to such limits of the copolymer poorer in acrylic or methacrylic acid giving rise to an antihalo layer which is too difficult to be removed in the subsequent washing step.

We have found that in the two copolymer mixture, the copolymer richer in acrylic or methacrylic acid may vary from 30 to 50% w/w with respect to the sum of the two resins, the remaining part consisting of the copolymer poorer in acrylic or methacrylic acid.

We have found that in the usual conditions of the photographic material processing, a mixture offering good characteristics of integrity in the pre-bath and removability in the subsequent washing step with mere water jets preferably consists of 53% w/w of the copolymer (methylmethacrylate-methacrylic acid) having 25% of methacrylic acid and of 47% w/w of the copolymer (methylmethacrylate-methacrylic acid) having 45% of methacrylic acid.

We have further found that the binding material, in which the antihalo agent of the composition of the present invention is dispersed, further to the mixture of the already described copolymers, may usefully contain other natural or synthetic resins soluble in water alkali, such as those already known in the art, e.g. cellulose acetophthalate, hydroxypropylmethylcellulose acetylphthalate, hydroxypropylmethylcellulose phthalate, hydroxypropylmethylcellulose hexahydrophthalate, maleic anhydride copolymers and vinyl comonomers, copolymers containing acrylic or methacrylic acid, etc. We have found in fact that a certain quantity of these resins is sometimes particularly desirable in addition to the copolymer mixture of the present invention to obtain a composition viscosity more suitable to the coating conditions of the antihalo layer on the supporting base of the photographic material.

We have found that hydroxypropylmethylcellulose phthalate is preferred to this purpose and that the hydroxypropylmethylcellulose phthalate quantity may vary from 0 to 15% w/w or the sum of the resins of the antihalo composition according to the present invention; too high quantities alter the characteristics of the antihalo layer (for instance, in the case of hydroxypropylmethylcellulose phthalate, they cause the layer to be less compact in the pre-bath).

The antihalo coating composition of the present invention is obtained by dispersing the antihalo agent in an organic solvent solution of the copolymer mixture, as described above according to the present invention.

The preferred antihalo agent is carbonblack, i.e. finely grinded carbon formed by particles having a diameter ranging from 1 to 100 mμ. Many types of finely grinded carbons are known, but the best ones are those which can be easily dispersed together with the copolymers of the present invention by means of a simple ball mill, e.g., Vulcan XC-72 (produced by Cabot Corporation) which is furthermore highly conductive.

Dispersed colloidal carbons or antihalo dyes can also be used.

Many types of dispersing agents can also be used to disperse carbonblack and give stable dispersions; those most well known in the art are the polynaphthalensulfonates.

Many useful solvent combinations have been found to form the above copolymer solution according to the present invention. As known in the art these solvent combinations can be chosen according to the particular supporting base on which the antihalo composition of the present invention is to be coated. Useful solvents may be, for example, methanol, acetone, methylcellosolve, ethylenglycol, etc.

The antihalo composition of the present invention can be coated on the hydrophobic supporting base of the photographic material by following various known techniques, such as for instance the spray, brush, roller, doctor blade, air knife technique, etc.

The supporting base is generally cellulose triacetate, but other bases can be used, such as for instance polyethylenterephthalate, thus obtaining as well a fairly good adherence of the antihalo layer even without the employment of sublayers known in the art.

The opposite supporting base side is provided with at least a silver halide emulsion layer, such as for instance silver bromide, silver chloride or silver iodide emulsions or emulsions containing a silver halide mixture, such as for instance silver bromo-iodide or silver chloro-bromide. Any type of emulsion known in the art which is or may be bath processed is useful in the present invention.

The invention is now further illustrated with more details in the following examples.

EXPERIMENTAL PART

The preparation of the copolymers useful in the mixture of the binding resins of the composition according to the present invention is illustrated in the following examples.

EXAMPLE A 4,800 ml. of ethanol, 240 g, equal to 2.8 moles, of methacrylic acid, 720 g, equal to 7.2 moles, of methylmethacrylate and 4.8 g of azo-bis-isobutyrronitrile were put, in the indicated order, into a three-necked flask. The mixture was then heated on water bath to reflux for 24 hours. The solution was cooled at room temperature and the polymer was precipitated by pouring the solution into a large volume of water under vigorous stirring. The product was filtered, washed with water and dried at 60° C. in the air for 24 hours. The yield was 845 g, equal to 88%. The weight content of methacrylic acid was 25%. The intrinsic viscosity in ethanol at 25° C. was 0.18 ml/g.

EXAMPLE B 4,650 ml of ethanol, 430 g, equal to 5 moles, of methacrylic acid, 500 g, equal to 5 moles, of methylmethacrylate and 9.3 g of azo-bis-isobutyrronitrile were put, in the indicated order, into a three-necked flask. The so-obtained mixture was treated as described in example A. The yield was 82% and the weight content of methacrylic acid was 45%. The intrinsic viscosity in ethanol at 25° C. was 0.23 g/ml.

The invention is now illustrated in the following examples in comparison with some prior art examples.

EXAMPLE 1 (prior art)

A 140μ thick cellulose triacetate film surface was coated, at a 30 ml/m² speed, with a dispersion of the following composition:

| | |
|---|---|
| Copolymer (methylmethacrylate-methacrylic acid) of Example A | 36 g |
| Vulcan XC-72 (produced by Cabot Corp.) | 9 g |
| Lissatan AC (condensate of naphthalene-sulfonic acid and formaldehyde produced by ICI) | 0.9 g |
| Acetone | 200 ml |
| Methanol | 630 ml |
| Methylcellosolve | 100 ml |
| Water | 70 ml |

The coating was then dried at 105° C. for 15 minutes, thus obtaining an antihalo layer having an optical density in the visible spectrum of about 1.

EXAMPLE 2 (prior art)

An antihalo layer was prepared as described in Example 1, using the copolymer (methylmethacrylatemethacrylic acid) of Example B in a quantity of 36 g, instead of the resin of Example A.

EXAMPLE 3 (invention)

An antihalo layer was prepared as described in Example 1, but using a mixture of 19 g of the resin of Example A and 17 g of the resin of Example B, instead of the resin of Example A.

EXAMPLE 4 (invention)

An antihalo layer was prepared as described in Example 1, using a mixture of 19 g of the resin of Example A, 15 g of the resin of Example B and 2 g of hydroxypropylmethylcellulose phthalate, instead of the resin of Example A.

EXAMPLE 5 (prior art)

A 140μ thick cellulose triacetate film surface was coated, at a 30 ml/m² speed, with a dispersion of the following composition:

| | |
|---|---|
| Terpolymer comprising ethylarylate 27%, acrylic acid 23% and methylmethacrylate 50% (according to U.S. Pat. No. 4,039,333) | 20 g |
| Hydroxypropylmethylcellulose phthalate | 10 g |
| Vulcan XC-72 | 10 g |
| Lissatan AC | 1 g |
| Acetone | 460 ml |
| Methanol | 420 ml |
| Methylcellosolve | 50 ml |
| Water | 70 ml |

The coating was then dried at 105° C. for 15 minutes, thus obtaining an antihalo layer having an optical density in the visible spectrum of about 1.

EXAMPLE 6 (prior art)

An antihalo layer was prepared as described in Example 1, using cellulose acetohexahydrophthalate in a quantity of 36 g, instead of the resin of Example A.

EXAMPLE 7 (prior art)

An antihalo layer was prepared as described in Example 1, using cellulose acetophthalate in a quantity of 36 g, instead of the resin of Example A.

EXAMPLE 8 (comparison of invention with prior art)

The base surface opposite to the antihalo layers of examples from 1 to 5 was coated, in the indicated order, with a subbing layer, a blue sensitive layer, a red sensitive layer and a green sensitive layer, with interlayers and a protective layer to provide a color photographic positive film. All these materials were then dipped into the standard pre-bath of the $ECP_2$ process having the following composition:

| | |
|---|---|
| Sodium sulfate | 100 g |
| Borax | 20 g |
| Sodium hydroxide | 1 g |
| Water to make | 1000 ml |

The pH value of such bath was 9.25 and the dipping time for the five materials was 120 seconds at 20° C.

Under these conditions, the antihalo layer of Example 2 was substantially removed in said pre-bath. The same occurred for a dipping time of 15 seconds, which is the normal time within the photographic ECP type processing as described before. This behavior caused scum formation and contamination in the pre-bath. Under the same dipping conditions, the antihalo layers of Examples 1, 3, 4 and 5, on the contrary, were not substantially removed.

EXAMPLE 9 (comparison of invention with prior art)

The antihalo layers described in Examples from 1 to 5 were respectively dipped at 20° C. and 27° C. into the same pre-bath of Example 6 and the Minimum Imbibition Time (M.I.T.) in the pre-bath necessary to remove completely the antihalo layer in the standard washing step with water and rotating buffer was measured (the washing was carried out using 20° C. water at 3 gallon/min. usage and 0.5 atm. pressure with Mohair as buffer material). The same operation was performed with other samples of the same antihalo layers storaged for 24 to 48 hours at 105° C. and 24% R.H. The following table shows the M.I.T. values at 20° C. for the various antihalo layers both under fresh and storage conditions (data at 27° C. are reported between brackets):

| Antihalo Layer of Example | 1 | 2 | 3 | 4 | 5 |
|---|---|---|---|---|---|
| Fresh | 120"(55") | 7"(3") | 9"(4") | 8"(4") | 10"(4") |
| 24 hour storage | ∞ | 13"(16") | 9"(4") | 9"(5") | ∞ |
| 48 hour storage | ∞ | 14"(7") | 12"(6") | 12"(6") | ∞ |

EXAMPLE 10 (comparison of invention with prior art)

The antihalo layers described in Examples from 1 to 5 were dipped into the pre-bath described in Example 6 for a time corresponding to their own M.I.T.s, then passed through the standard washing with only water without rotating buffers.

The same was done with other samples of the same antihalo layers storaged for 24 and 48 hours at 105° C. and 25% R.H. The following table reports the residual fog of the antihalo read as optical density of absorption in the visible field.

| Antihalo Layer of Example | 1 | 2 | 3 | 4 | 5 |
|---|---|---|---|---|---|
| Fresh | 0.00 | 0.36 | 0.00 | 0.00 | 0.09 |
| 24 hour storage | ≈1.00 | 0.38 | 0.00 | 0.00 | ≈1.00 |
| 48 hour storage | ≈1.00 | 0.40 | 0.00 | 0.00 | ≈1.00 |

EXAMPLE 11 (comparison of invention with prior art)

The base surface opposite to the antihalo layers of Examples 4, 6 and 7 was coated, in the indicated order with a subbing layer, two red sensitive layers, two green sensitive layers, a yellow filter and a blue sensitive layer, with interlayers and a protective layer to provide photographic color reversal movie films. All three materials were then processed in the standard processing steps for EM-25 Process, i.e.

| Solution/Step | Temperature (°C.) | Time (Sec.) |
|---|---|---|
| Prehardener | 51.7 ± 0.1 | 37 |
| Neutralizer | 51.7 ± 2.8 | 32.5 |
| Rem-jet Remover | 51.7 ± 2.8 | 2 |
| Rinse | 51.7 ± 2.8 | 3 |

Rinse was effected by only water sprays without buffer rollers as provided in the standard rinse. Under these conditions, the antihalo layer of Example 4 remained well compact and without any removal in the standard neutralizer, had a M.I.T. value of 1 second in the standard rem-jet remover and was totally removed in the rinsing step with only water sprays without "veil" of antihalo layer; the antihalo layer of Example 6 behaved as the previous one in the standard neutralizer, had a M.I.T. value of 1 second in the standard rem-jet remover but left a residual "veil" in the rinsing step with only water sprays; finally the antihalo of Example 7 was substantially removed in the standard neutralizer step causing contamination of the emulsion side of the film and the subsequent processing solution.

The term w/w indicates the weight percent of a single ingredient to the total weight of copolymer components.

We claim:

1. Photographic material comprising a supporting base, at least a silver halide emulsion layer coated on one side of said supporting base and an antihalo layer coated on the other side of said supporting base for use in a photographic process which comprises an alkaline imbibing bath and subsequent water washing bath, wherein said antihalo layer is imbibed in said imbibing bath and is removed in said washing bath in respectively predeterminated times characterized in that such antihalo layer comprises an antihalo agent and a mixture of two copolymers of a low alkylmethacrylate and acrylic or methacrylic acid, the first one being richer in acrylic or methacrylic acid and comprising 40 to 50 percent by weight of said acrylic or methacrylic acid and the second one being less rich in acrylic or methacrylic acid and comprising 20 to 30 percent by weight of said acrylic or methacrylic acid, the relative quantities of acrylic or methacrylic acid in the two copolymers and the ratios in which they are mixed providing an antihalo layer imbibible in said imbibing bath and removable in said washing step, said antihalo layer comprising from 30 to 42 weight percent of the sum of the two copolymers of said first copolymer and from 53 to 60 weight percent of the sum of the two copolymers of said second copolymer.

2. Photographic material as per claim 1 characterized in that the antihalo layer consists essentially of an antihalo agent and said first copolymer is a copolymer of (1) alkylmethacrylate, where such alkyl contains from 1 to 4 carbon atoms, and (2) acrylic or methacrylic acid, and said second copolymer is a copolymer of alkylmethacrylate, where such alkyl contains from 1 to 4 carbon atoms.

3. Photographic material as per claim 1 characterized in that the first copolymer is a methylmethacrylate-methacrylic acid copolymer having from 42 to 48 weight percent of methacrylic acid, and the second copolymer is a methylmethacrylate-methacrylic acid copolymer having from 22 to 28 weight percent of methacrylic acid.

4. Photographic material as per claim 1 characterized in that the first copolymer is a methylmethacrylate-methacrylic acid copolymer having 45 weight percent of methacrylic acid, and the second copolymer is a methylmethacrylate-methacrylic acid copolymer having 25 weight percent of methacrylic acid.

5. Photographic material as in claim 1 characterized in that the antihalo layer, in addition to the antihalo agent and the two copolymer mixture, contains a resinous viscosity control agent soluble in an alkaline water solution.

6. Photographic material as of claim 5 characterized in that such soluble resin comprises a synthetic copolymer or a cellulose derivative containing carboxylic groups.

7. Photographic material of claim 5 characterized in that such soluble resin comprises hydroxypropylmethylcellulose phthalate.

8. Photographic material as in claim 7 characterized in that the antihalo layer contains from 30 to 42 weight percent of the low alkylmethacrylate-acrylic or methacrylic acid copolymer richer in acrylic or methacrylic acid and from 53 to 60 weight percent of the low alkylmethacrylate-acrylic or methacrylic acid copolimer less rich in acrylic or methacrylic acid and from 0 to 15 weight percent of the resin soluble in an alkaline water solution.

9. Photographic material as in claim 1 characterized in that such antihalo agent is carbonblack.

10. In a method to prepare a photographic material, which includes a supporting base, at least a silver halide emulsion layer coated on one side of said supporting base and an antihalo layer coated on the other side of said supporting base, for use in a photographic process which comprises an alkaline bath and a subsequent water washing bath, wherein said antihalo layer is imbibed in said imbibing bath and is removed in said washing bath in respectively predeterminated, times, the improvement consisting in that said antihalo layer comprises an antihalo agent and a mixture of two copolymers of a low alkylmethacrylate and acrylic or methacrylic acid, the first one being richer in acrylic or methacrylic acid and comprising 40 to 50 percent by weight of said acrylic or methacrylic acid and the second one being less rich in acrylic or methacrylic acid and comprising 20 to 30 percent by weight of said acrylic or methacrylic acid, the relative quantities of acrylic or methacrylic acid in the two copolymers and the ratios in which they are mixed providing an antihalo layer imbibible in said imbibing bath and removable in said washing step, said antihalo layer comprising from 30 to 42 weight percent of the sum of the two copolymers of said first copolymer and from 53 to 60 weight percent of the sum of the two copolymers of said second copolymer.

* * * * *